US007614375B2

(12) United States Patent
Tawaf et al.

(10) Patent No.: US 7,614,375 B2
(45) Date of Patent: Nov. 10, 2009

(54) ROLLER BEARING AND Z-STOP FOR A TWO-STEP ROLLER FINGER FOLLOWER

(75) Inventors: Cynthia A. Tawaf, Rochester, NY (US); Andrew J. Lipinski, Wiesbaden (DE); William D. Bauman, Dorr, MI (US); Carl R. Kangas, Sand Lake, MI (US); Albert C. Stone, Grandville, MI (US); Eric G. Wilusz, Rush, NY (US); Hermes Fernandez, Pittsford, NY (US); Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 113 days.

(21) Appl. No.: 11/904,010

(22) Filed: Sep. 25, 2007

(65) Prior Publication Data

US 2008/0072855 A1 Mar. 27, 2008

Related U.S. Application Data

(60) Provisional application No. 60/847,245, filed on Sep. 26, 2006.

(51) Int. Cl.
*F01L 1/18* (2006.01)

(52) U.S. Cl. ..... 123/90.39; 123/90.16; 123/90.44

(58) Field of Classification Search ..... 123/90.16, 123/90.15, 90.39, 90.44; 74/569
See application file for complete search history.

(56) References Cited

U.S. PATENT DOCUMENTS 5,709,180 A 1/1998 Spath
6,615,782 B1 * 9/2003 Hendriksma et al. ..... 123/90.39
6,997,152 B2 2/2006 Harris

OTHER PUBLICATIONS

PCT Search Report dated May 12, 2008.

* cited by examiner

*Primary Examiner*—Zelalem Eshete
(74) *Attorney, Agent, or Firm*—Thomas N. Twomey

(57) ABSTRACT

A two-step roller finger follower having a high-lift follower portion that pivots on a pivot shaft disposed on a low-lift follower portion, and having a lost-motion spring disposed between the high-lift follower and the low-lift follower to bias the high-lift follower toward the high lift cam lobe. Various bearing cups and roller shaft sleeve embodiments are shown, all of which allow for improved shaft and needle bearing arrangements. A z-stop formed by the bearing cups and/or the shaft sleeve limits the range of travel of the high-lift follower with respect to the low-lift follower. Various z-stop embodiments are provided including a non-contacting roller shaft sleeve that grounds the high-lift follower to the low-lift follower independent of the roller shaft.

12 Claims, 6 Drawing Sheets

ROLLER BEARING AND Z-STOP FOR A TWO-STEP ROLLER FINGER FOLLOWER

RELATIONSHIP TO OTHER APPLICATIONS AND PATENTS

This application claims the benefit of U.S. Provisional Application No. 60/847,245, filed Sep. 26, 2006.

TECHNICAL FIELD

The present invention relates to roller finger followers for actuating the valves of internal combustion engines; more particularly, to two-step roller finger followers for controllably changing the lift of engine valves; and most particularly, to a two-step roller finger follower having a bearing cup and/or roller shaft. A travel stop for preventing leak-down of the hydraulic lash adjuster is also provided.

BACKGROUND OF THE INVENTION

Two-step roller finger followers (RFF) for the controllable lift of compression valves in a valve train of an internal combustion engines are well known. An RFF extends between a hydraulic lash adjuster (HLA) and the stem of a valve. Engagement with an eccentric cam lobe of an engine camshaft causes the RFF to be pivoted about the HLA and thereby to depress the valve stem, opening the valve. A two-step RFF mechanism allows an engine valve to be operated by two different cam lobe profiles, one with the mechanism locked, providing a high valve lift, and the other with the mechanism unlocked, providing a lower lift or no lift.

When the mechanism is unlocked, the RFF portion that is not directly in contact with the valve stem and the HLA, known in the art as the high-lift follower, typically is provided with a biasing spring, known in the art as a "lost-motion" spring, to keep that portion in contact with the cam. A lost-motion spring, which may be a torsional spring or a compression spring, is disposed in compression between the high-lift follower and the remainder of the RFF, known in the art as the body or low-lift follower, which is directly in contact with the valve stem and the HLA. Thus, when the high-lift follower engages the cam lobe, a force is exerted by the spring against the HLA. If the force of the lost motion spring is too small, the high-lift follower may not be able to stay in contact with the high-lift cam lobe under all engine operating conditions causing valve train clatter. If the spring force is too large, the force of the lost motion spring may overcome the force of an internal spring in the HLA, causing the HLA to leak down and become undesirably compressed and depleted of oil.

In cases where the lost motion spring exerts a greater force than the internal spring in the HLA, excessive leak-down can be prevented by mechanically limiting the amount of relative travel between the high-lift follower and low-lift follower, as imposed by the lost motion spring, when the high-lift follower is in contact with the base circle of the high-lift cam. This can be done by providing a mechanical stop that limits the rotation of the high-lift follower relative to the low-lift follower hereafter referred to as the z-stop.

Also, in a two-step RFF having a spool-type roller set wherein the roller shaft of the set contains a roller at each end and extends through the RFF, roller bearing assemblies are disposed in opposing walls of the low-lift follower to support rotation of the roller shaft. The bearings are self-contained in the assembly. That is, the assembly includes a cup-shaped housing for receiving the bearings, the housing being closed at each lateral end to restrain the bearings laterally. Because of the need to roll-over or close the ends of the assembly to retain the roller bearings therewithin, at least one end of the housing must be non-hardened, and the bearings shortened to fit within the shortened housing. Shorter bearings reduce the life and durability of the bearings and can cause excessive wear to the mating components served by the bearings. Further, a non-hardened housing as required for rolling over the end of the housing cannot be also employed as a satisfactory z-stop for the high-lift follower.

What is needed in the art is a two-step roller finger follower having an improved z-stop arrangement wherein unacceptable HLA leak-down, caused by the compressive force of the lost motion spring, is prevented.

What is also needed in the art is an improved roller shaft bearing for increased bearing life.

What is further needed in the art is an improved roller shaft bearing arrangement that also provides a z-stop arrangement.

It is a principal object of the present invention to prevent unacceptable HLA leak-down caused by compressive force of the lost motion spring.

It is a further object of the invention to increase roller shaft bearing life through the use of longer bearings.

It is a still further object of the invention to provide both an improved bearing and a z-travel stop feature in a roller shaft bearing arrangement.

SUMMARY OF THE INVENTION

Briefly described, a two-step RFF in accordance with the invention includes a high-lift follower portion that rotates relative to a low-lift follower portion about a pivot shaft in the low-lift follower portion. A lost-motion spring is disposed between the high-lift follower and the low-lift follower to bias the high-lift follower away from the low-lift follower. An improved roller shaft bearing arrangement is provided that can be used in the space provided for prior art bearings, permitting the advantageous use of longer bearings, more bearings, and/or a larger diameter roller shaft. A z-stop is provided to limit the range of travel of the high-lift follower away from the low-lift follower. Various z-stop embodiments are provided using a ground path other than directly through the roller shaft, including a sleeve surrounding the roller shaft that grounds the high-lift follower to the low-lift follower independent of the roller shaft.

BRIEF DESCRIPTION OF THE DRAWINGS

The present invention will now be described, by way of example, with reference to the accompanying drawings, in which.

DESCRIPTION OF THE PREFERRED EMBODIMENTS

The benefits and advantages of a two-step RFF in accordance with the present invention will be better appreciated by first considering a representative prior art two-step RFF.

Figure 1:
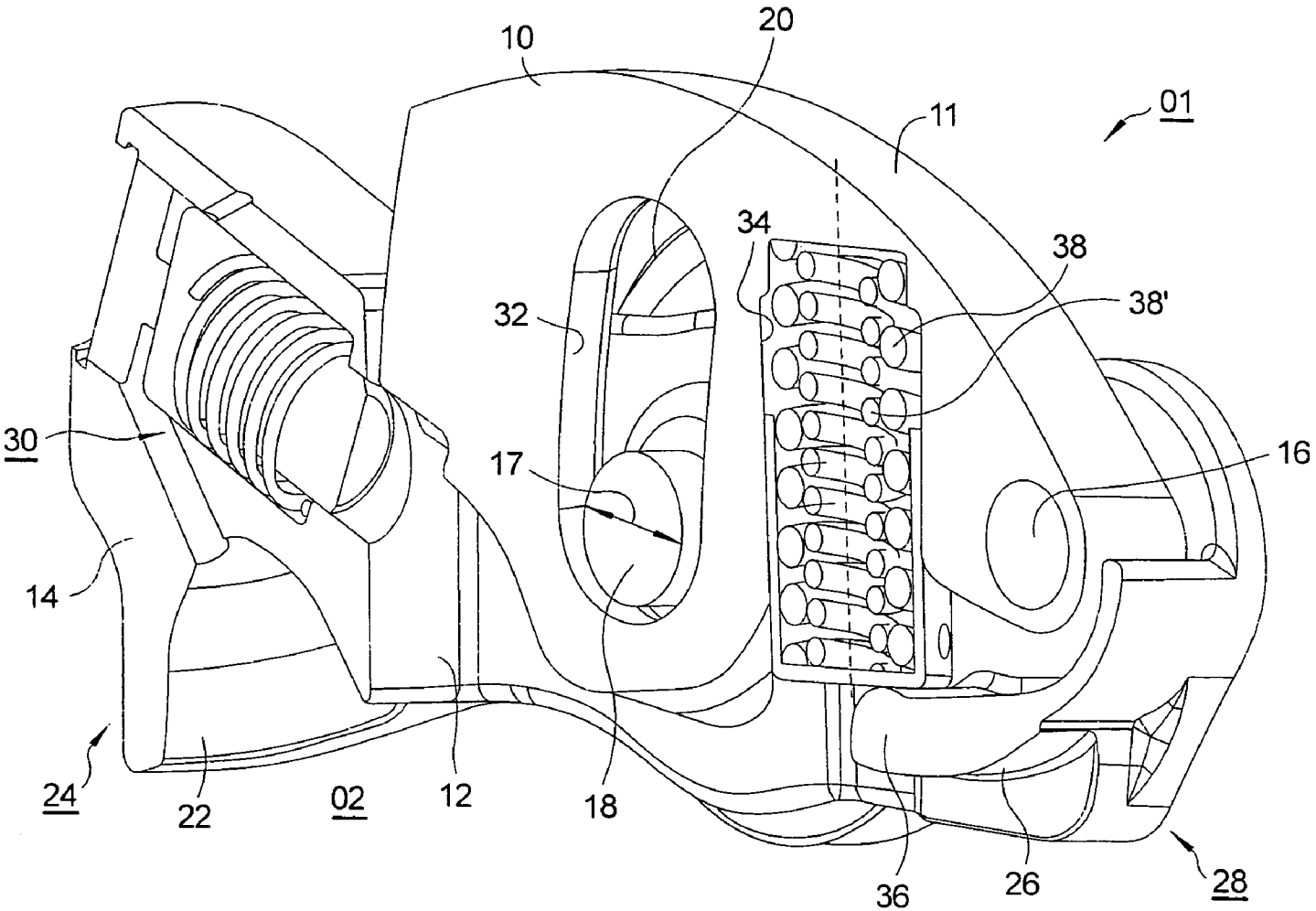
FIG. 1. (PRIOR ART)
FIG. 1 is a cutaway view of the prior art two-step RFF shown in FIG. 2 sectioned longitudinally.
Figure 2A:
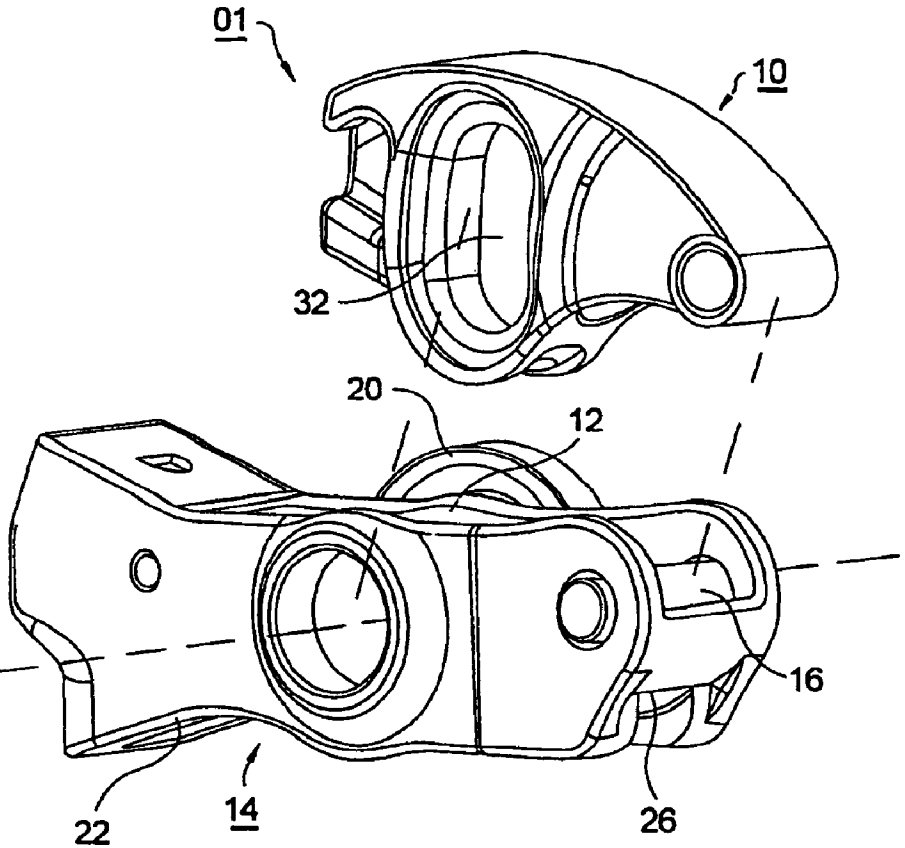
FIG. 2a. (PRIOR ART)
FIG. 2*a* is an exploded isometric view of the two-step RFF shown in FIG. 2.
Figure 2:
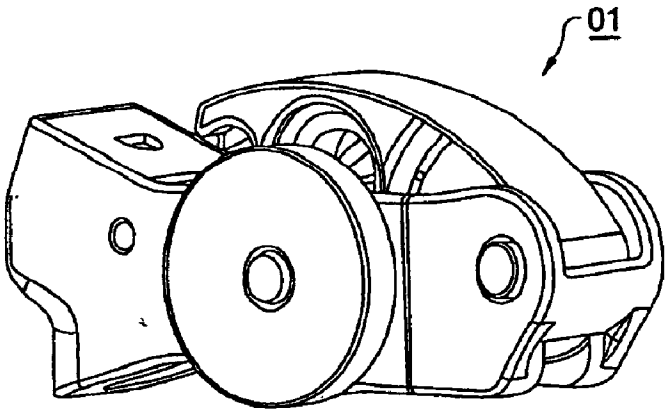
FIG. 2. (PRIOR ART)
FIG. 2 is an isometric view of a prior art two-step RFF.
Figure 2:
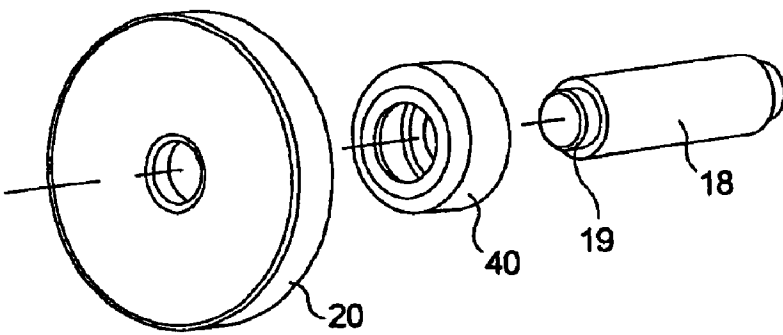
FIG. 2. (PRIOR ART)

Referring to prior art FIGS. 1 through 4, RFF 01 is formed generally in accordance with the two-step RFF prior art. Such a two-step RFF is suitable for use in a variable valve activation system of an internal combustion engine 02. The view shown in FIG. 1 represents a section cutaway along a vertical symmetry plane of the RFF shown in FIG. 2 for description purposes such that only one-half of the RFF is present. Thus, where appropriate, the described elements should be considered as having matching but not shown counterparts in the full RFF.

A high-lift follower 10 including a cam-follower surface 11 is disposed in a central opening 12 in a generally box-shaped low-lift follower 14. High-lift follower 10 pivots within opening 12 about a pivot shaft 16. A roller shaft 18 mounted in low-lift follower 14 supports a pair of end rollers 20 to form a spool-shaped roller assembly 21 for following a low-lift lobe of an engine camshaft (not shown). Rollers 20 are press-fittedly received by roller shaft ends 19. It is understood that rollers 20 may be secured by the press-fit alone, or secured to shaft ends 19 by, for example, welding, bonding, riveting, or staking. Low-lift follower 14 includes a socket 22, for pivotably mounting RFF 01 at a first end 24 thereof on a fulcrum such as an HLA (not shown), and a pad 26 at a second end 28 thereof for actuating a valve stem (not shown). A latching assembly 30 disposed in low-lift follower 14 selectively latches high lift follower 10 in position to move the valve stem in an opening lift in response to the high-lift cam lobe base circle and eccentric, or selectively unlatches high-lift follower 10 to follow the high-lift cam lobe base circle and eccentric in lost motion. In the unlatched mode, roller 20 comes in contact with a low-lift cam lobe base circle and eccentric to move the valve stem through a lower lift (which may be no lift at all). Arcuate slot 32 in high-lift follower 10 accommodates roller shaft 18 during the pivoting motions of high-lift follower 10 about pivot shaft 16. Slot 32 is sized to provide full side-to-side clearance to diameter 17 through the full travel of high-lift follower 10 and to allow full lost motion stroke of high-lift follower 10.

Blind bore 34 is formed in high-lift follower 10, opening adjacent shoe 36 formed in low-lift follower 14. Lost motion spring 38, as for example compression springs 38, 38' as shown, resides in bore 34 and pushes against shoe 36 and an end wall of bore 34 to provide a force to rotationally move high lift follower 10 away from low-lift follower 14, high-lift follower 10 moving generally in a clockwise direction and low-lift follower 14 moving generally in a counter-clockwise direction as shown in FIG. 1, to bias high-lift follower into continuous contact with the high-lift cam lobe during all phases of rotation thereof.

Figure 4:
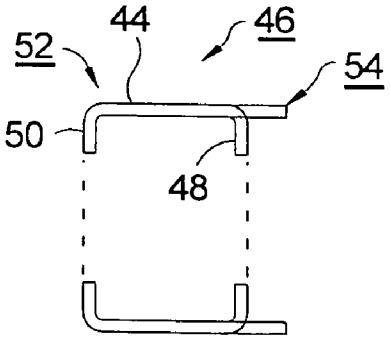
FIG. 4. (PRIOR ART)
FIG. 4 is a view of the roller shaft bearing cup of the two-step RFF shown in FIG. 2.
Figure 3:
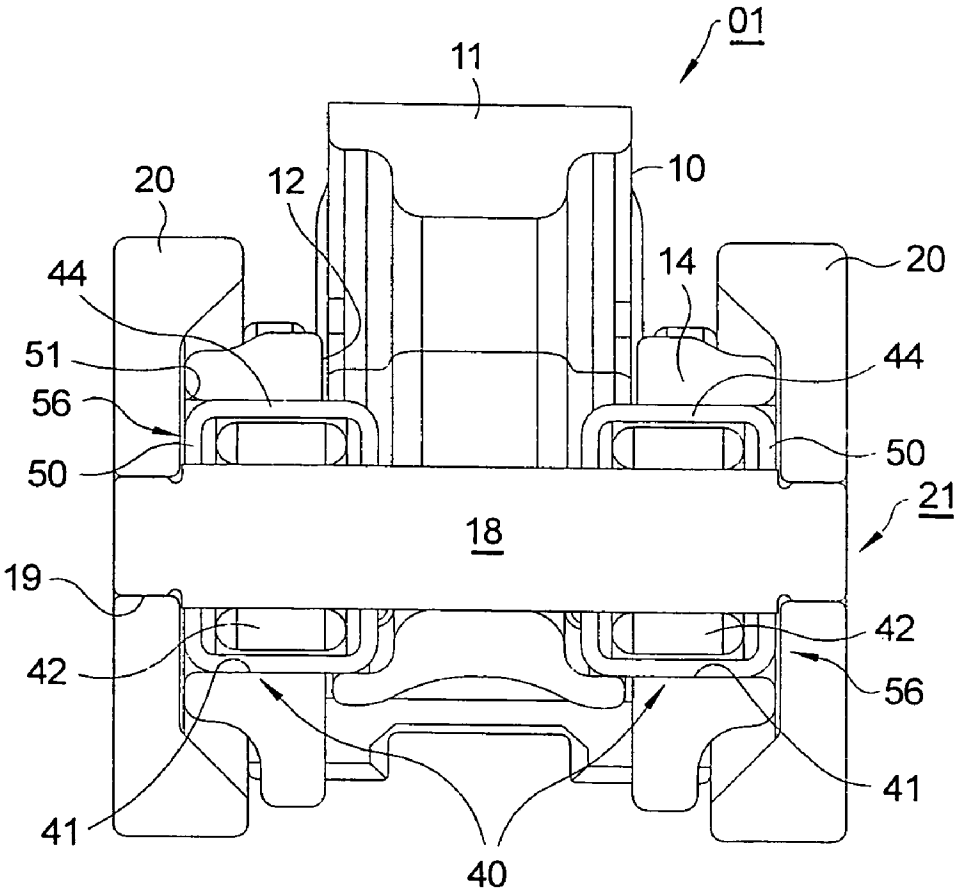
FIG. 3. (PRIOR ART)
FIG. 3 is a cutaway view of the two-step RFF shown in FIG. 2, sectioned through the centerline of the roller shaft.

Roller shaft 18 is held in rotational position in low-lift follower 14 by a pair of drawn-cup needle bearing assemblies 40 press fittedly received in shaft orifices 41. Each bearing assembly 40 includes a plurality of hardened needle bearings 42 received within cylindrical portion 44 of cup 46 of the assembly. In its assembled condition, prior art cup 46 further includes inside flange 48 and outside flange 50 for retaining needle bearings 42 within cup 46, at least one of the flanges having been formed by rolling in of a cylindrical end of the cup element, as shown in FIG. 4, during assembly after insertion of the needle bearings into the cup. Prior to assembling the needle bearings into cup 46, only one end such as outside flange 50 is pre-formed in cylindrical portion 44 of the cup, then portion 52 of the cup is hardened to permit press-fit installation of the cup as described below. Then, after needle bearings 42 (not shown in FIG. 4) are installed in the hardened cup, unhardened portion 54 of the cup is rolled inward thereby containing needle bearings 42 laterally within the cup to form needle bearing assembly 40.

Referring again to FIG. 3, after pre-assembling the prior art drawn needle bearing assembly as just described, assembly 40 is oriented so that outside flange 50 (which includes hardened portion 52) faces outward relative to bearing orifice 41 of low-lift follower 14. Then, a tool (not shown) is used to press the needle bearing assembly in place in direction 56 such that outside flange 50 is positioned in close relationship with an inside surface 51 of roller 20. It is important to note that the non-hardened portion 54 of inside flange 48 must be selectively positioned inward so that the pressing tool, used to press-fittedly install the bearing assembly, bears on hardened portion 52 of bearing cup 46 and not on the non-hardened portion 54, else the cup will become distorted and the bearings jammed.

Referring back to FIG. 1, when high-lift follower 10 engages the cam lobe, a force is exerted by the spring against the HLA. If the force of the lost motion spring is too large, and the outward relative travel of the high-lift and low-lift followers remains unchecked, the force of the lost motion spring can overcome the force of the internal spring in the HLA and can cause the HLA to leak down and become undesirably compressed and depleted of oil.

Referring to FIGS. 5 through 10, various embodiments of a two-step RFF as improved in accordance with the present invention will now be discussed.

RFF 100 of a first embodiment provides an improved roller shaft bearing that includes provisions for a mechanical z-stop to prevent leak down by limiting the amount of upward travel of the high-lift follower relative to the low-lift follower, as imposed by the lost motion spring, when the high-lift follower is on the base circle portion of the high-lift cam.

Figure 5:
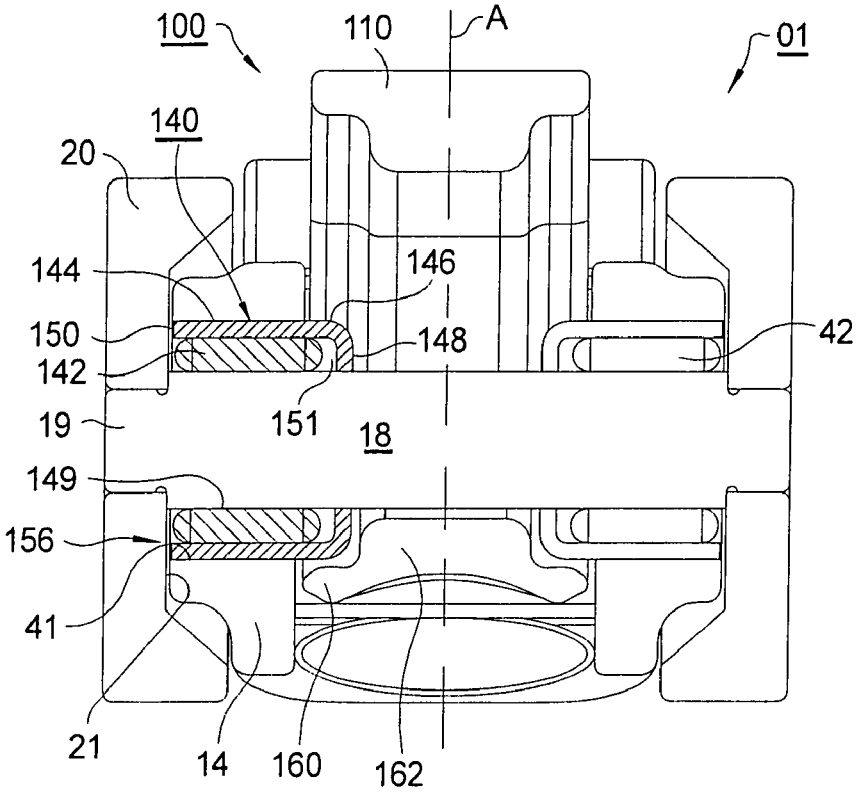
FIG. 5 is a cutaway view of a two-step RFF in accordance with a first embodiment of the invention sectioned through the centerline of the roller shaft.

Referring to FIG. 5, the features shown to the left of split line A depict first embodiment 100 in accordance with the present invention, and the features shown to the right depict the equivalent prior art features 01 generally as shown in FIGS. 1-4 and discussed above. Bearing unit 140 includes cup shaped member 146 formed to include cylindrical portion 144, inside flange 148 and end surface 150. Note that the portion of cup member 146 near end surface 150 is open, that is, lacking in an enclosing flange as in the prior art. Bearing unit 140 also includes a plurality of needle bearings 142 received within cylindrical portion 144 of cup member 146. Unlike cup 46 where only a portion of the cup could be hardened, cup member 146 may be hardened in its entirety after forming inside flange 148, since it is not necessary to roll over the outer end of cup member 146 to laterally retain needle bearings 42.

To assemble first embodiment 100, each hardened cup member 146 is oriented so that end surface 150 faces outward relative to shaft orifice 41. Then, a tool (not shown) is used against hardened end surface 150 to press the cup member in place in direction 156 so that end surface 150 will be positioned in close relationship with an inside surface 51 of roller 20. Then, roller shaft 18 is fitted through central opening 149 of each cup member 146 to thereby centrally align shaft relative to cup member 146 to form annular needle bearing chamber 151. After needle bearings 142 are aligned and positioned within bearing chamber 151, rollers 20 are press-fittedly received by roller shaft ends 19, and optionally secured to shaft ends 19 by, for example, welding, bonding, riveting, or staking to thereby secure the bearings in place by the inside surface 51 of the roller. It is an important aspect of the present invention that, since cup member 146 does not require a rolled over outer end flange, roller bearings 142 that are significantly longer than prior art bearings 42 may advantageously be used. Also, the orientation of hardened end surface 150 for pressing into orifice 41 is readily apparent by its shape.

Referring momentarily to prior art RFF 01 in FIG. 1, leak-down of the HLA (not shown) is caused by the force of high-lift follower 10 pushing against the base circle of the high-lift cam (not shown) and causing low-lift follower 14 to push against the HLA.

In first embodiment 100 (FIG. 5), since cup member 146 may be hardened in its entirety, inside flange 148 is also hardened along portion 152 and may be used as a mechanical z-stop when inserted to a depth sufficient that outside flange 148 can interfere with travel of the high-lift follower 110. Preferably, ear 160 is formed in a lower portion 162 of high-lift follower 110 so that ear 160 may make contact with inside flange 148 of cup member 146 if it is desired to controllably limit travel of high-lift follower 110 relative to low-lift follower 14, in the z-direction, to prevent HLA leak-down during the base circle portion of the lift event. An important aspect of embodiment 100 is that the z-stop grounds the high-lift follower directly to the low-lift follower via cup member 146. Thus, the high-lift follower does not directly contact roller shaft 18 which rotates with the rotation of rollers 20. Such contact with the shaft is undesirable because it could impart a rotational resistance to the shaft as it spins relative to the low-lift follower or could impart a bending moment directly on the shaft which could cause mis-alignment of the rollers, with consequent bearing wear and loosening of the joint between the rollers and the shaft.

Figure 6:
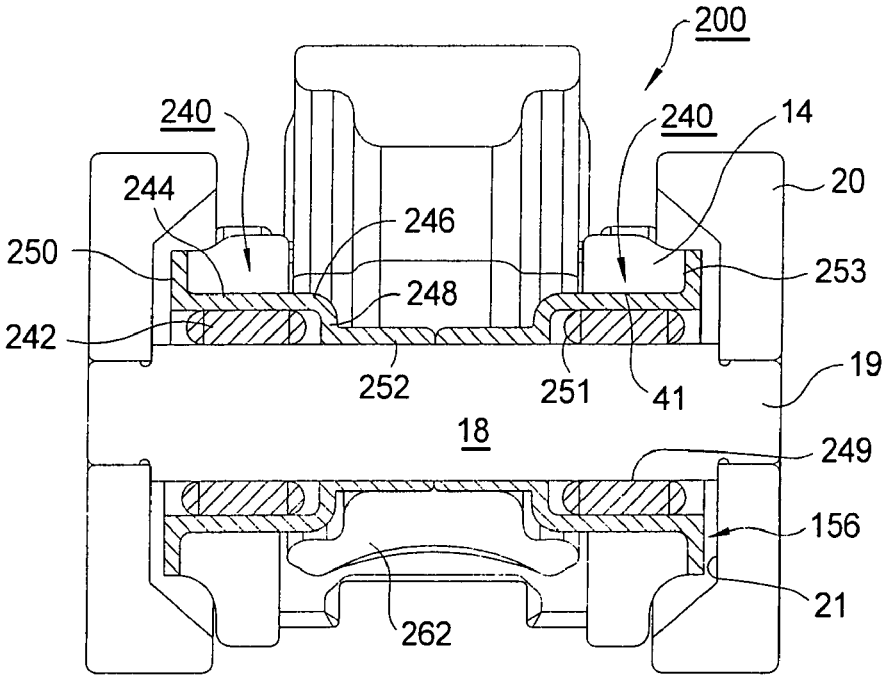
FIG. 6 is a cutaway view of a two-step RFF in accordance with a second embodiment of the invention sectioned through the centerline of the roller shaft.

Second RFF embodiment 200, shown in FIG. 6, also provides an improved roller shaft bearing that includes provisions for a mechanical z-stop. Two identical bearing units 240 each include cup member 246 formed to include cylindrical portion 244, inside flange 248, end flange 250, and nose portion 252. Each bearing unit 240 also includes a plurality of hardened needle bearings 242, substantially identical with bearings 142 in FIG. 5, received within cylindrical portion 244 of cup member 246. Unlike cup 46 where only a portion was hardened, cup member 246, like cup member 146, may be hardened in its entirety, including nose portion 252, since it is not necessary to roll over an end of cup member 246 to laterally retain needle bearings 242.

To assemble the second embodiment, each hardened cup member 246 is oriented so that outside flange 250 faces outward relative to the outward opening of shaft orifice 41. Then, a tool (not shown) is used to press against hardened outside flange 250 until the flange contacts an outside wall 253 of low-lift follower 14, pressing the cup member into place in direction 156 so that outside flange 250 will be positioned in close relationship with an inside surface 51 of roller 20. Then, roller shaft 18 is fitted through central opening 249 of each cup member 246 to thereby centrally align shaft 18 relative to cup member 246 to form an annular needle bearing chamber 251. Roller shaft 18 preferably is not in contact with the inner surfaces of nose portions 252. After needle bearings 242 are aligned and positioned within bearing chamber 251, rollers 20 are press-fittedly received by roller shaft ends 19, and optionally secured to shaft ends 19 by, for example, welding, bonding, riveting, or staking. Since cup member 246, in accordance with the invention, does not require a rolled over end flange to retain the bearings, longer roller bearings 242 may advantageously be used.

Since cup member 246 may be hardened in its entirety, nose portion 252 is also hardened and may be used as a mechanical z-stop. Thus, lower portion 262 of slot 232 of high-lift follower 210 is positioned to make contact with hardened nose portion 252 of cup member 246 if it is desired to controllably limit travel of high-lift follower 210 relative to low-lift follower 14, in the z-direction, to prevent HLA leak-down during the base circle portion of the lift event. An important aspect of this embodiment as well is that the z-stop grounds the high-lift follower directly to the low-lift follower via cup member 246. Thus, the high-lift follower does not directly contact roller shaft 18, which is not in contact with nose portion 252, wherein contact with the shaft could impart a rotational resistance to the shaft as it spins relative to the low-lift follower or could impart a bending moment directly on the shaft which could cause mis-alignment of the rollers, with consequent bearing wear and loosening of the joint between the rollers and the shaft.

Figure 7:
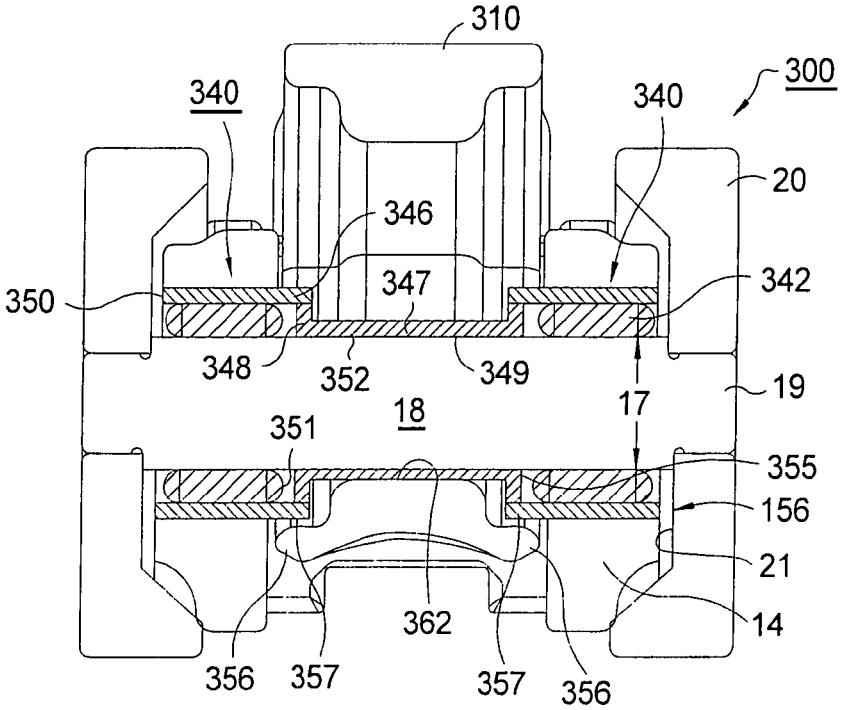
FIG. 7 is a cutaway view of a two-step RFF in accordance with a third embodiment of the invention sectioned through the centerline of the roller shaft.

Referring to FIG. 7, third RFF embodiment 300 provides an improved roller shaft bearing that also includes provisions for a mechanical z-stop. Two identical bearing units 340 each include cylindrical member 346 and end surface 350. Each bearing unit 340 also includes bearing central sleeve 347 having elongate central portion 352, flange portion 348 formed at each end of central portion 352, and through-bore 349 through which roller shaft 18 is passed. The outside diameter of flange portion 348 is sized to be close-fittedly received by the inside diameter of cylindrical member 346. The diameter of through-bore 349 is sized to be slightly larger than diameter 17 of roller shaft 18 so that clearance 355 is provided between the shaft and through-bore 349 after assembly of RFF 300. Bearing unit 340 also includes a plurality of hardened needle bearings 342 received within a bearing chamber 351 defined by an inside wall of cylindrical member 346 and flange portion 348. Cylindrical member 346 may be hardened, as needed.

To assemble third embodiment 300, each hardened cylindrical member 346 is pressed into its associated shaft orifice in direction 156 so that end surface 350 will be positioned in close relationship with an inside surface 51 of roller 20. Then, flange portion 348 of bearing central sleeve 347 is fitted through the inside diameter of one cylindrical member 346, through slot 32 formed in high-lift follower 10 (FIG. 1), then into the inside diameter of the opposite cylindrical member 346. The shape, size and position of slot 32 must be selected so it will allow passage of flange portion 348 during assembly. After central sleeve 347 is in place between each cylindrical member 346, roller shaft 18 is passed through bore 349 to thereby centrally align shaft 18 relative to cylindrical member 346 to form annular needle bearing chamber 351. After needle bearings 342 are aligned and positioned within bearing chamber 351, rollers 20 are press-fittedly received by roller shaft ends 19, and optionally secured to shaft ends 19 by, for example, welding, bonding, riveting, or staking. Since cylindrical member 346, in accordance with the invention, does not require a rolled over end flange to retain the bearings, longer roller bearings 342, similar in length to bearings 142 (FIG. 5), may be used.

Either end 357 of cylindrical portion 346 or central portion 352 of bearing central sleeve 347 can serve as a z-stop against ear 360 or lower portion 362 of slot 332, respectively, to controllably limit travel of high-lift follower 310 relative to low-lift follower 14 in the z-direction to prevent HLA leak-down during the base circle portion of the lift event. An important aspect of this embodiment as well is that the z-stop grounds the high-lift follower directly to the low-lift follower. Thus, the high-lift follower does not directly contact the roller shaft where contact with the shaft could impart a rotational resistance to the shaft as it spins relative to the low-lift follower or could impart a bending moment directly on the shaft which could cause mis-alignment of the rollers, resulting in bearing wear and loosening of the joint between the rollers and the shaft.

Figure 8:
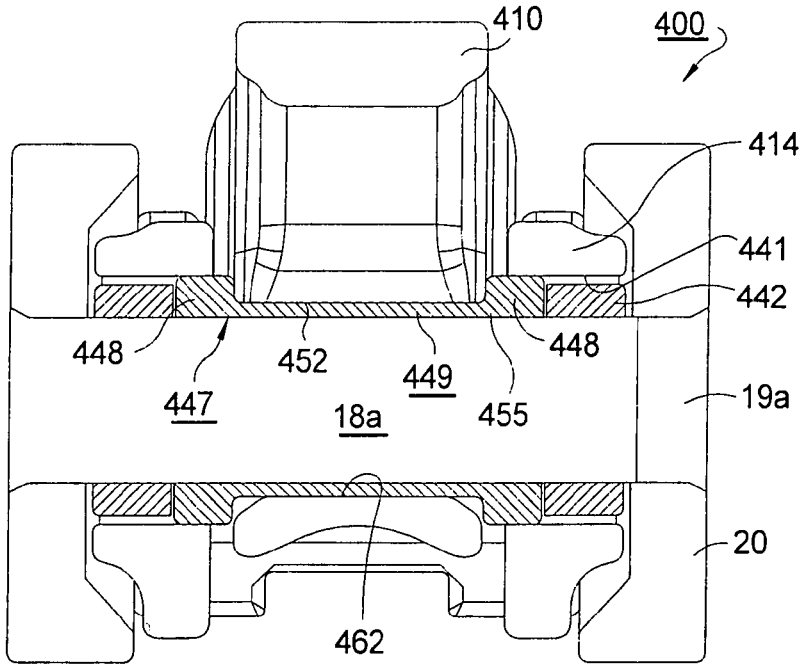
FIG. 8 is a cutaway view of a two-step RFF in accordance with a fourth embodiment of the invention sectioned through the roller shaft.

Referring to FIG. 8, fourth RFF embodiment RFF 400 is similar to third embodiment (FIG. 7) except cylindrical member 346 has been deleted and the needle bearings 442 ride directly against the shaft orifice. Note that elimination of the cylindrical member beneficially allows a larger diameter shaft 18*a* and larger diameter bearings 442 in the same size shaft orifices 441.

This embodiment may also provide a mechanical z-stop to prevent excessive leak down of the HLA during the base circle portion of the lift event. Bearing unit 440 includes shaft orifices 441 in low-lift follower 414. Bearing unit 440 also includes bearing central sleeve 447 having central elongate portion 452, flange portion 448 formed at each end of central portion 452, and a through-bore 449 through which the roller shaft 18*a* passes. The outside diameter of flange portion 448 is sized to be close-fittedly received by the inside diameter of shaft orifice 441. The diameter of through-bore 449 is sized to be slightly larger than the diameter of the roller shaft so that a clearance 455 is provided between the shaft and the through bore after assembly of RFF 400. Bearing unit 440 also includes a plurality of hardened needle bearings 442 received within the bearing chamber defined by shaft orifice 441 and flange portion 448.

To assemble the fourth embodiment, flange portion 448 of bearing central sleeve 447 is first fitted through one shaft orifice 441, through slot 32 formed in high-lift follower 10 (FIG. 1), then into the inside diameter of the opposite shaft orifice 441. The shape, size, and position of slot 32 must be selected so that slot 32 provides clearance to central portion 452 for the entire range of motion of the high lift follower. A locally larger relief is required at only one orientation to allow passage of flange portion 448 during assembly. After central sleeve portion is in place between each shaft orifice, the roller shaft is passed through the through-bore of central sleeve 447 to thereby centrally align the shaft relative to shaft orifice 441 to form an annular needle bearing chamber similar to the previous embodiments. After needle bearings 442 are aligned and positioned within the bearing chamber, rollers 20 are press-fittedly received by the roller shaft ends 19*a*, and optionally secured to the shaft ends by, for example, welding, bonding, riveting, or staking. It is an important advantage of embodiment 400 that, since a cylindrical member is not required in shaft orifice 441, a larger shaft 18*a* and/or needles 442, longer needles, and/or more needles may advantageously be used, thus providing a more robust bearing.

Central portion 452 of bearing central sleeve 447 can serve as a z-stop against lower portion 462 of slot 432, to controllably limit travel of high-lift follower 410 relative to low-lift follower 414, in the z-direction, to control HLA leak-down during the base circle portion of the lift event. An important aspect of this embodiment as well is that the z-stop grounds the high-lift follower directly to the low-lift follower. The high-lift follower does not directly contact roller shaft 18*a* wherein contact with the shaft could impart a rotational resistance to the shaft as it spins relative to the low-lift follower or could impart a bending moment directly on the shaft which could cause mis-alignment of the rollers, resulting in bearing wear and loosening of the joint between the rollers and the shaft.

Figure 9:
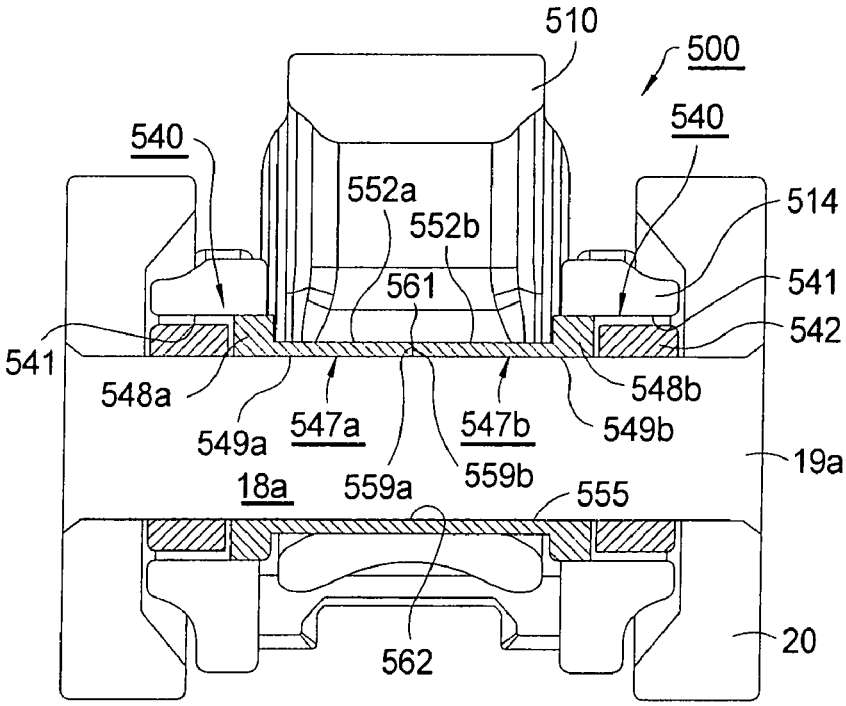
FIG. 9 is a cutaway view of a two-step RFF in accordance with a fifth embodiment of the invention sectioned through the roller shaft.

Referring to FIG. 9, a fifth RFF embodiment 500 is similar to fourth embodiment 400 (FIG. 8) except that instead of the bearing center sleeve being formed in one piece, it consists of two mirror image pieces centrally split along a plane perpendicular to its central axis. As in fourth embodiment 400, cylindrical member 446 has been deleted, that is, the needle bearings ride directly against the shaft orifice.

This embodiment may also provide a mechanical z-stop to prevent leak down of the HLA during the base circle portion of the lift even. Bearing unit 540 includes shaft orifices 541 in low-lift follower 514. Bearing unit 540 also includes a first central sleeve 547*a* having central portion 552*a*, flange portion 548*a* formed at an end of central portion 552*a*, abutting face 559*a* formed at the other end of central portion 552*a*, and a through-bore 549*a* through which roller shaft 18*a* is passed. A second central sleeve 547*b*, identical to and a mirror image of first central sleeve 547*a*, is disposed next to first central sleeve 547*a*, having central portion 552*b*, flange portion 548*b* formed at an end of central portion 552*b*, abutting face 559*b* formed at the other end of central portion 552*b*, and a through-bore 549*b* through which roller shaft 18*a* is passed. The outside diameter of flange portions 548*a,b* of each central sleeve is sized to be slightly smaller than the inside diameter of shaft orifice 541 so that a slidable clearance 555 is provided between each central sleeve and shaft orifice. The diameter of through-bores 549*a,b* of each central sleeve is sized to be slightly larger than the diameter of the roller shaft after assembly of RFF 500, allowing clearance 555 therebetween. Bearing unit 540 also includes a plurality of hardened needle bearings 542 received within a bearing chamber defined by shaft orifice 541 and flange portion 548 of each sleeve.

To assemble fifth embodiment 500, each central sleeve 547*a* and 547*b* is inserted, abutting ends 559*a,b* first, through its respective shaft orifice 541. Abutting ends 559*a,b* are then inserted into slot 32 of high-lift follower 10 (FIG. 1), leaving joint 561 between adjacent abutting ends 559*a,b*. An aspect of this embodiment is that the size of slot 32 may be reduced as compared to the slots of previous embodiments (third and fourth) since slot 32 need not be sized to allow passage of the larger diameter of flange portion 548 during assembly. After first and second sleeves 547*a*, 547*b* are in place as described above, the roller shaft is passed through the through-bores of the central portions to thereby centrally align the shaft relative to shaft orifice 541 to form an annular needle bearing chamber. After the needle bearings are aligned and positioned within the bearing chamber, the rollers 20 are press-fittedly received by the roller shaft ends 19*a*, and optionally secured to the shaft ends by, for example, welding, bonding, riveting, or staking.

Central portions 552 of one or both of first and second bearing central sleeves 547*a* and 547*b* can serve as a z-stop against lower portion 562 of slot 32, to controllably limit travel of high-lift follower 510 relative to low-lift follower 514, in the z-direction, to control HLA leak-down during the base circle portion of the lift event. Note that, in this embodiment, the z-stop does not ground the high-lift follower directly to the low-lift follower but rather to central sleeves 547*a,b* that may contact roller shaft 18*a*. However, since the entire length of the two bores combined will be brought to bear on the roller shaft, and the surface of the rotating shaft and mating through bore are thoroughly lubricated, any rotational resistance to the rotating shaft caused by its contact by the through bores is minimal. Further, since the z-stop force exerted on the shaft is distributed along the entire length of the through bores, bending of the shaft is minimal.

Figure 10:
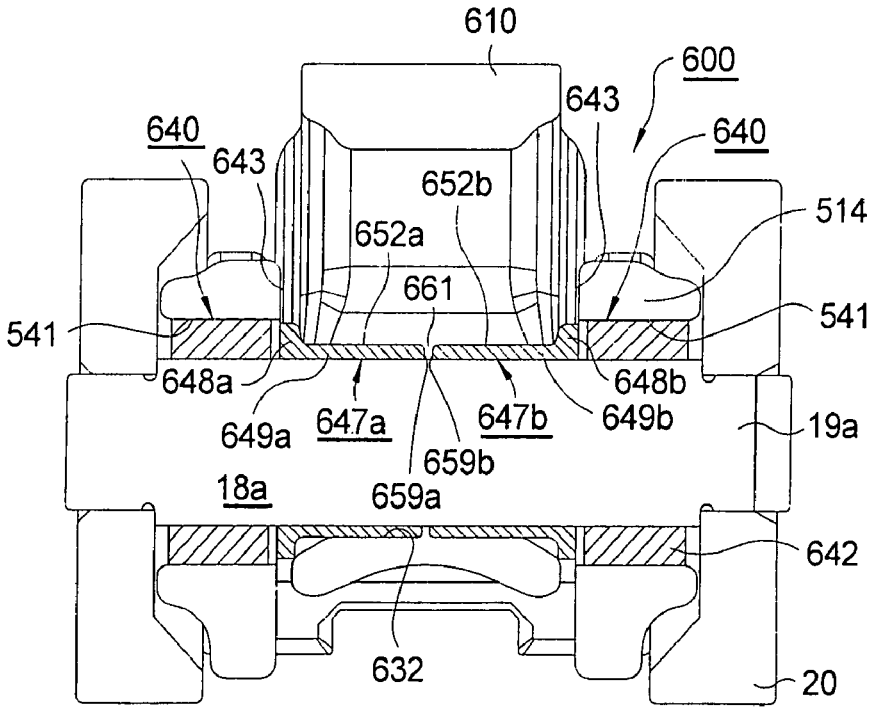
FIG. 10 is a cutaway view of a two-step RFF in accordance with a sixth embodiment of the invention sectioned through the roller shaft.

Referring to FIG. 10, a sixth RFF embodiment 600 is similar to fifth embodiment 500 (FIG. 9) except that instead of the flange portion of each central sleeve residing within the inside diameter of shaft orifice 541, after assembly the flange portions reside only adjacent to respective inside faces of the low-lift follower. As in fifth embodiment 500, the bearing center sleeve consists of two mirror image pieces 647*a*, 647*b*. Like the fourth and fifth embodiments, cylindrical member 446 has been deleted. This embodiment can also provide a mechanical z-stop to prevent leak down of the HLA during the base circle portion of the lift event. Bearing unit 640 includes shaft orifices 541 in low-lift follower 514. Bearing unit 640 includes a first central sleeve 647*a* having central portion 652*a*, flange portion 648*a* formed at an end of central portion 652*a*, an abutting face 659*a* formed at the other end of central portion 652*a* (similar to that shown in FIG. 9), and a through-bore 649*a* through which roller shaft 18*a* is passed. A second central sleeve 647*b*, identical to and a mirror image of first central sleeve 647*a*, is disposed next to first central sleeve 647*a*, having central portion 652*b*, flange portion 648*b* formed at an end of central portion 652*b*, an abutting face 659*b* formed at the other end of central portion 652*b*, and a through-bore 649*b* through which roller shaft 18*a* is passed. The outside diameter of flange portion 648 of each central sleeve is sized to be slightly smaller than the inside diameter of shaft orifice 541 so that a slidable clearance is provided between each central sleeve and shaft orifice. The diameter of the through-bore of each central sleeve is sized to be closely fitted to the diameter of the roller shaft after assembly of RFF 600. Bearing unit 640 also includes a plurality of hardened needle bearings 642 received within a bearing chamber defined by shaft orifice 541 and an end face of flange portion 648 of each sleeve.

To assemble sixth embodiment 600, each central sleeve 647*a* and 647*b* is inserted, abutting end first, through its respective shaft orifice 541. The abutting ends are then inserted into slot 32 of high-lift follower 10 (FIG. 1), leaving a joint 661 between adjacent abutting ends. An aspect of this embodiment is that the size of slot 32 may be reduced as compared to the slots of the first, second, third and fourth embodiments since slot 32 need not be sized to allow passage of the larger diameter of flange portion 648 during assembly. After first and second sleeves 647*a*, 647*b* are in place so that each flange 648*a,b* remains engaged with its respective shaft orifice 541, roller shaft 18*a* is passed through the through-bores to form an annular needle bearing chamber. When the needle bearings are aligned and positioned within the bearing chamber, the first and second sleeves 647*a*, 647*b* are pushed to a final position adjacent to inside face 643 of low lift follower 514, and then rollers 20 are press-fittedly received by roller shaft ends 19*a*, and optionally secured to the shaft ends by, for example, welding, bonding, riveting, or staking. Since a cylindrical member is not required in shaft orifice 441, a larger shaft 18*a* and/or needles 642, longer needles, and/or more needles may be used.

As an alternate assembly method, instead of inserting central sleeves 647*a*, 647*b* through respective shaft orifices, central sleeves 647*a*, 647*b* may be inserted into central opening 12 from above (as oriented in FIG. 10) by first rotating high-lift follower 610 upward out of low-lift follower 514 so that slot 32 of the high-lift follower clears the side walls of low-lift follower 514. Then, each central sleeve may be inserted into slot 32, abutting face first, then the high-lift follower 610 may be rotated downward back into central opening 12 to bring the through-bores of the central sleeves in alignment with the central axis of shaft orifices 541 by holding the high-lift follower 610 in the proper position. The roller shaft can then be passed through the through bores to form an annular needle bearing chamber for receiving the needle bearings as described above. Note that, with the alternate assembly method, the outside diameter of flange portion 648 of each central sleeve may be sized to be larger than the inside diameter of shaft orifice 541 since the flange need not pass through the orifice.

Central portions 652*a,b* of both of first and second bearing central sleeves 647*a,b* can serve as a z-stop against the lower portion of slot 32, to controllably limit travel of high-lift follower 610 relative to low-lift follower 514, in the z-direction, to control HLA leak-down during the base circle portion of the lift event. Note that, in this embodiment, the z-stop does not ground the high-lift follower directly to the low-lift follower because central sleeves 647*a,b* may contact roller shaft 18*a*. However, since the entire length of the two bores combined is brought to bear on the roller shaft, and the surface of the rotating shaft and mating through-bore are thoroughly lubricated, any rotational resistance to the rotating shaft caused by its contact by the through-bores is minimal. Further, since the z-stop force exerted on the shaft is distributed along the entire length of the through-bores, bending of the shaft is also minimal.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A two-step roller finger follower for use in a variable valve actuation train of an internal combustion engine, comprising:

a) a low-lift cam follower having a central aperture, a first end in communication with a fulcrum point, a second end in communication with a valve of said engine, and a rotatable shaft receivable in at least one shaft orifice;

b) a high-lift cam follower disposed to pivot in said central aperture about a pivot shaft in said low-lift cam follower and having a transverse slot opening therethrough for receiving said rotatable shaft;

c) a bearing unit disposed between said rotatable shaft and said at least one shaft orifice; and d) a stop for engaging said high-lift cam follower to limit the rotation of said high-lift cam follower with respect to said low-lift cam follower wherein said stop includes a shaft sleeve surrounding said rotatable shaft.

2. A two-step roller finger follower in accordance with claim 1 wherein said bearing unit includes a plurality of bearings disposed between said rotatable shaft and said shaft orifice.

3. A two-step roller finger follower in accordance with claim 1 wherein said bearing unit includes a plurality of bearings in contact with said rotatable shaft and said shaft orifice.

4. A two-step roller finger follower in accordance with claim 1 wherein said shaft is rotatably movable relative to said shaft sleeve.

5. A two-step roller finger follower in accordance with claim 2 wherein said bearing unit includes a housing disposed within said shaft orifice, wherein said plurality of bearings is receivable by said housing, and wherein said housing includes first and second lateral ends, at least one of said ends being open and non-supportive of an end of at least one of said plurality of bearings.

6. A two-step roller finger follower in accordance with claim 5 wherein at least a portion of said housing is hardened.

7. A two-step roller finger follower in accordance with claim 6 wherein said hardened portion defines said stop.

8. A two-step roller finger follower in accordance with claim 1 further including a spring operationally disposed between said low-lift cam follower and said high-lift cam follower wherein said spring biases the high-lift cam follower to rotate with respect to the low-lift cam follower toward a high lift cam lobe.

9. A two-step roller finger follower in accordance with claim 1 wherein said low-lift cam follower includes a second shaft orifice for receiving said rotatable shaft and a bearing unit disposed between said rotatable shaft and said second shaft orifice, wherein said bearing unit disposed between said rotatable shaft and said second shaft orifice includes a housing, and wherein said housing includes first and second lateral ends, at least one of said ends being open and non-supportive of an end of at least one of a plurality of bearings.

10. A two-step roller finger follower in accordance with claim 9 wherein at least a portion of said housing of said bearing unit disposed between said rotatable shaft and said second shaft orifice is hardened.

11. A two-step roller finger follower in accordance with claim 10 wherein said hardened portion of said housing of said bearing unit disposed between said rotatable shaft and said second shaft orifice defines a second stop.

12. A two-step roller finger follower in accordance with claim 11 wherein said second stop includes a second shaft sleeve surrounding said rotatable shaft.

* * * * *